340-870.12 SR
3/8/88 XR 4,730,183

United States Patent [19]
Crowe

[11] Patent Number: 4,730,183
[45] Date of Patent: Mar. 8, 1988

[54] MULTIPLE-MODE DATA ACQUISITION SYSTEM

[75] Inventor: Wayne D. Crowe, Houston, Tex.

[73] Assignee: Ferranti Subsea Systems, Ltd., London, England

[21] Appl. No.: 680,402

[22] Filed: Dec. 10, 1984

[51] Int. Cl.[4] ..... G08B 21/00
[52] U.S. Cl. ..... 340/870.16; 340/870.12; 340/870.26
[58] Field of Search ..... 340/870.16, 870.21, 340/870.11, 825.06, 825.07, 870.12, 870.26; 370/85

[56] References Cited

U.S. PATENT DOCUMENTS 4,349,821 9/1982 Vancsa ..... 340/870.21
4,356,486 10/1982 Mount ..... 340/870.21
4,382,287 5/1983 Ackman et al. ..... 340/825.06

*Primary Examiner*—John W. Caldwell, Sr.
*Assistant Examiner*—Tyrone Queen
*Attorney, Agent, or Firm*—Norvell & Associates

[57] ABSTRACT

A local data unit (10) provides sequenced acquisition and transmission of data signals received in different signal formats from local and remotely deployed sensors (24, 28). The network uses a microprocessor based stage (42) to sequentially control acquisition of the data signals via an analog multiplexer (16) and conversion of those data signals into a binary format via either a voltage-to-frequency converter (48) and frequency digitizer (58) or, after normalization, directly via the frequency digitizer (58). Data transmission in a normal mode is achieved by using the binary data signals to toggle input reference signals applied to multiplexer (16) between low and high potentials, and applying those potentials to voltage to frequency converter (48) while a data transmitter (52) is held in an enabled conditon. The tone of the resulting frequency shift keyed signal is sensed by a carrier detector (82) which in turn enables a master telemetry receiver (80) to receive the data signals after conversion by a decoder (84). In a fallback mode activated upon failure of the processing unit, the multiplexer is sequentially addressed to apply the incoming data signals to the voltage-to-frequency converter (48) while the data transmitter (52) is held in an enabled condition. After detecting the occurrence of the partial failure, the master processing unit shifts to alternate binary conversion modes to accommodate the formats of the directly transmitted data signals in accordance with the scanning sequence of the fallback mode scanner (74).

15 Claims, 6 Drawing Figures

MULTIPLE-MODE DATA ACQUISITION SYSTEM

TECHNICAL FIELD

This invention pertains to electrical data acquisition systems and, more particularly, to systems for acquiring and encoding data from a plurality of local and remote sources for transmission to a distant location.

BACKGROUND ART

In data acquisition systems, information about a plurality of parameters is often obtained by simultaneously deploying numerous sensors. Various factors such as physical restrictions limiting access to the sensors, their remoteness, and the cost of cable, require acquisition and processing of signals from the sensors at a local unit before transmission to a distant master data processing unit. Moreover, in many applications the acquired signals must be monitored and processed locally to assure timely activation of local process controls and then temporarily stored to facilitate sequential transmission of data signals from all of the local sensors to the master processing unit.

The transmission format between the local unit of the acquisition system and the master unit is determined by consideration of such factors as limited frequency responses available through the connecting cables and differences in the data acquisition rates of various sensors. Systems such as that disclosed in Vancsa, U.S. Pat. No. 4,349,821 and in Nelligan, U.S. Pat. No. 4,012,712 suggest various data multiplexing and local signal storage schemes, respectively, in endeavors to enhance transmission resolution of signals acquired over parallel channels from several sensors. The electrical links providing data transmission channels between a local unit and the sensors used in monitoring process controls in such fields as submerged petroleum production facilities, for example, often require different signal output formats to accommodate for differences in the relative proximity of sensors to the local data acquisition station (e.g., signals transmitted over longer electrical links are more susceptible to picking up noise and are influenced by the greater link resistence), and to take into consideration special transmission requirements imposed on interconnections (e.g., inductive couplings) between some of the links and the local acquisition unit. There is a need therefore, for a data acquisition system which accommodates differences in possible operating modes and characteristics of various sensor channels. Moreover, while it may be desirable in particular applications to locally process data signals before transmission to a central distant master processing unit, it is highly desirable that in the event of failure of the processing stage at the local unit, the data signals be reliably transmitted directly to the master unit in a format which can be accurately decoded.

SUMMARY OF THE INVENTION

Accordingly, it is one object of the present invention to provide an improved data acquisition system.

It is another object to provide a system for acquiring and relaying data generated in different signal formats by a plurality of sensors.

It is yet another object to provide a system for more accurately acquiring and relaying data generated in different signal formats by a plurality of sensors.

It is yet another object to provide a system which, after suffering a partial system failure, is usable for reliably acquiring and relaying data generated in different signal formats by a plurality of sensors.

It is still yet another object to provide a data acquisition system which accommodates differences in operating modes and characteristics between incoming data channels.

It is another object to provide a method for accurately and reliably encoding data signals from incoming channels having different operating modes and characteristics.

These and other objects are achieved with a multiple-mode data acquisition system and method of operation in which a local unit sequentially acquires and transmits to a master data processing unit data signals received in a plurality of formats, during both normal and fallback modes. The local unit includes a multiplexer sequentially receiving incoming data signals and applying those signals via different analog-to-digital converter stages to a micro-processor based telemetry encoding and transmitting logic stage. After processing and storage in binary form, the micro-processor stage addresses a pair of input ports of the multiplexer receiving different reference potentials and uses the binary signal to toggle the multiplexer between those potentials to drive a voltage-to-frequency converter included in one of the analog-to-digital converter stages while enabling a data transmitter, thereby causing the resulting modulated signal within a predetermined frequency band to be relayed to the master unit. In a fallback mode, failure of the microprocessor is accommodated by shifting control of the multiplexer to a preprogrammed mode scanner which sequentially switches the multiplexer between its several input data signal ports while the data transmitter is held in an enabled condition, thereby directly transmitting the incoming data signals within the predetermined frequency band to the master data processing unit.

The master processing unit includes a detector which signals a central microprocessor based telemetry receiver upon reception of a signal within the predetermined frequency band and a signal decoder which applies data signals extracted from that frequency band directly to the microprocessor. In a fallback mode, the master unit accommodates direct transmission of data signals in the predetermined frequency band by sequentially converting those signals via a frequency digitizer into binary data which is then applied to the microprocessor based telemetry receiver.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
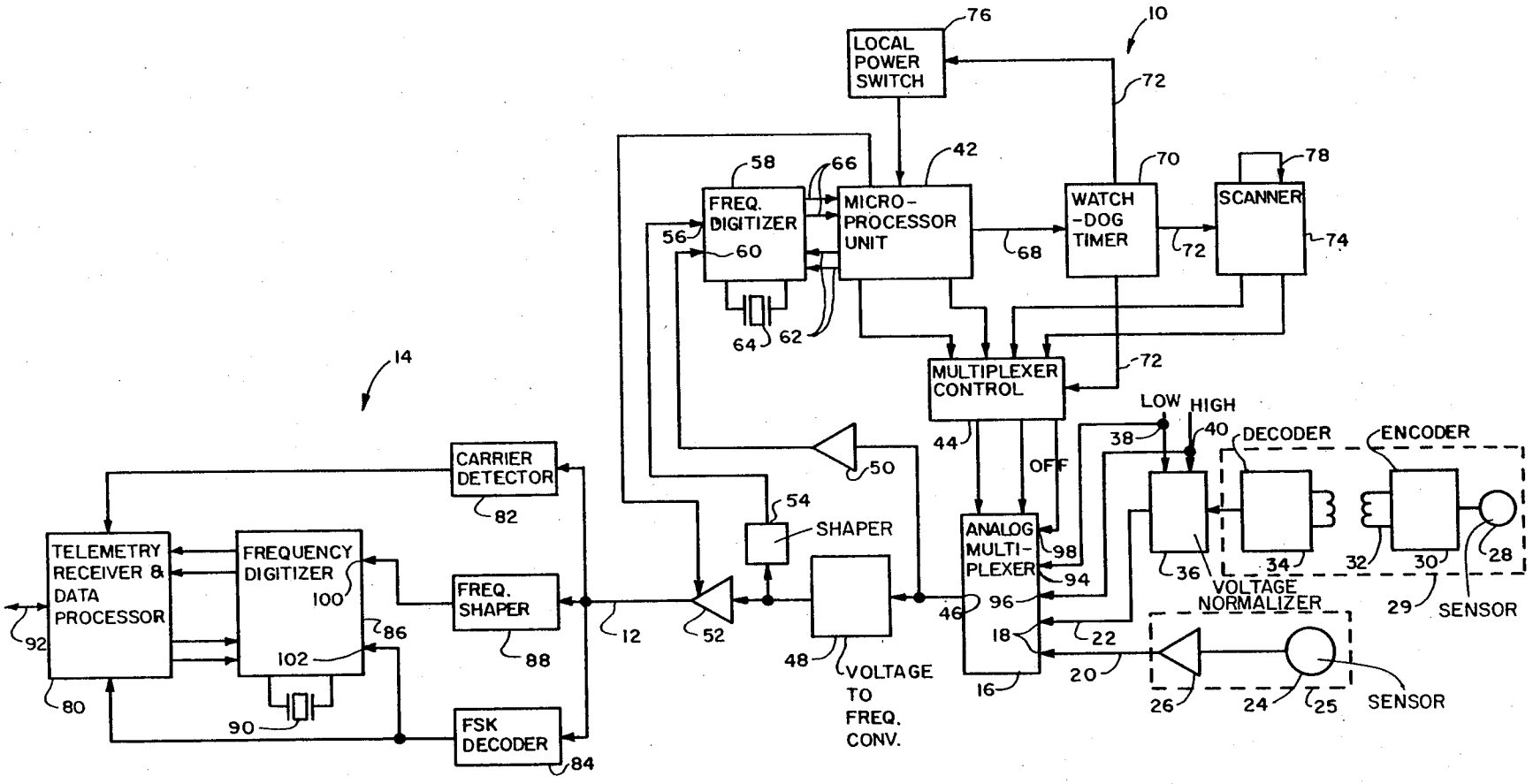
FIG. 1 is a single line block diagram schematic of an embodiment of a data acquisition system.

Refer now to FIG. 1 where a local unit 10 of a data acquisition system is connected via a single pair cable 12 to a distantly located master data processing unit 14. Local unit 10 includes an analog multiplexer 16 having a plurality of input ports 18 coupled to receive incoming data signals from groups of numerous local sensor channels 20, only one of which is shown, and remote sensor channels 22, only one of which is shown. Two groups of data signal links are represented by the two channels shown. The first channel, 20, couples a sensor 24 which is disposed in relative proximity to the network, and connected through its local connecting link 25 via a dedicated amplifier 26 to one of the input ports 18. In the second type, a sensor 28 is disposed relatively remotely from local unit 10 and is coupled to multiplexer 16 via a remote connecting link 29 which includes a voltage-to-frequency encoder 30, an inductive coupler 32, a decoder 34, a voltage normalizer 36 and one of the remote data signal channels 22. Voltage normalizer 36 is coupled to receive a low reference potential 38 and a high reference potential 40, and serves to convert digital data signals in a variable frequency low signal band (e.g., less than 150 Hertz) established by the encoder and decoders of connecting link 29 to either a low reference level or a high reference level, thereby normalizing the voltage amplitudes of data signals emanating from the remote sensor decoders. Data signals arriving at multiplexer 16 via local signal channels 20 are in an analog voltage format while data signals arriving via remote signal channels 22 are normalized square wave signals alternating between the reference voltage amplitudes at a rate within the variable frequency low band at a frequency proportional to the value of the analog signal emanating from sensor 28.

Periodically, a microprocessor based telemetry encoding and transmitting logic unit 42 sequentially scans the input channels of multiplexer 16 via a multiplexer control 44, thereby sequentially connecting input ports 18 to an output port 46 of the multiplexer. The microprocessor based logic unit 42 is a microprocessing stage provided by a commercially available unit such as a model NSC 800 available from National Semiconductor. Output port 46 is coupled to a voltage-to-frequency converter 48 operating in a variable frequency high band (e.g., 3000 to 5000 Hertz) and a voltage level comparator 50. Converter 48 is coupled to both the input port of a data transmitter 52 and a waveform shaper 54. The waveform shaper is in turn coupled to one input port 56 of a frequency digitizer 58. The output of comparator 50 is coupled to a second input port 60 of frequency digitizer 58. The input of signals via ports 56, 60 into frequency ditigizer 58 is controlled by microprocessor stage 42 via control leads 62 to control admission of input data via either port 56 or 60 to the exclusion of input data arriving via the other of those two ports. Frequency digitizer 58 converts frequency domain variable frequency high and low band signals into binary format in a gated reference frequency counting measurement technique using an external crystal 64 as an accurate frequency reference. In combination, waveform shaper 54 and frequency digitizer 58 serve to provide an analog-to-digital conversion of data signals arriving from multiplexer 16 via voltage-to-frequency converter 48 while signals arriving at input port 60 are normalized by comparator 50 to voltage amplitudes conforming to input specification levels of digitizer 58 and microprocessor stage 42. As signals arriving via input port 60 are in a variable frequency low signal band while those arriving via port 56 are in a variable frequency high signal band, microprocessor stage 42 controls the input frequency counting interval utilized by frequency digitizer 58 as a part of the frequency digitizing cycle. Data signals are applied to microprocessor stage 42 by frequency digitizer 58 via data leads 66 as the input data signals are converted into a binary signal format.

In addition to providing sequenced addressing of input ports 18 for multiplexer 16 and input ports 56, 60 for digitizer 58, the microprocessor based telemetry encoding and transmitting logic unit 42 performs processing and temporary storage for the data signals in their binary format.

As a regular operational function, microprocessor unit 42 conducts a self-testing routine to discover the occurrence of internal failure. Upon successful conclusion of that routine, microprocessor stage 42 generates a watchdog timing pulse via lead 68 to watchdog timer 70. Unsatisfactory completion of the self-testing routine prevents generation of the watchdog timing pulse. The omission of the timing pulse during a subsequent interval of predetermined length triggers a shift in the operational mode of network 10 from its normal data acquisition and transmitting mode to a fallback mode and allows watchdog timer 70 to generate a mode-shifting signal via leads 72 to control operation of multiplexer control 44, fallback mode scanner 74 and local power switch 76. Fallback mode scanner 74 is preprogrammed by means such as mode patch jumpers 78, to sequentially address, via multiplexer control 44, and connect input channels 18 to output channel 46 in multiplexer 16. Reception of the mode shifting signal from timer 70 causes multiplexer control 44 to allow input port address signals from mode scanner 74 to address input ports 18 in multiplexer 16. To assure deactivation of the microprocessor unit, timer 70 also applies the mode-shifting signal to local power switch 76, thereby removing power to microprocesser stage 42 to assure its complete disablement. The absence of power to the microprocessor stage 42 removes its ability to inhibit the activation of data transmitter 52, which is the mode of control used, thereby enabling direct transmission of data signals to master unit 14 via voltage-to-frequency converter 48.

Master data processing unit 14 includes a microprocessor based telemetry receiver and data processor 80. Voltage-to-frequency converter 48 converts signals to be transmitted via data transmitter 52 and cable pair 12 to variable frequency signals within the variable frequency high band. A detector 82 responds to reception of signals in the variable frequency high band by providing a carrier detect indication signal which causes telemetry receiver 80 to either receive transmission via frequency shift key decoder 84 or to enable frequency digitizer 86 to alternatively convert direct transmission of data into binary data via frequency shaper 88 or decoder 84 during a fallback mode transmission. Frequency digitizer 86 is a gated reference frequency counting stage using an external crystal 90 to provide accurate binary conversion of data signals in either the variable frequency high or variable frequency low bands. Telemetry receiver data processor 80 controls operation of decoder 84, digitizer 86, and frequency shaper 88 to permit reception of data signals from network 10 during its normal transmission mode and during both phases of its fallback transmission mode. Binary data received and processed by receiver 80 is then applied via output port 92 to such types of external networks as data interfaces or central control systems (not shown).

Figure 2:
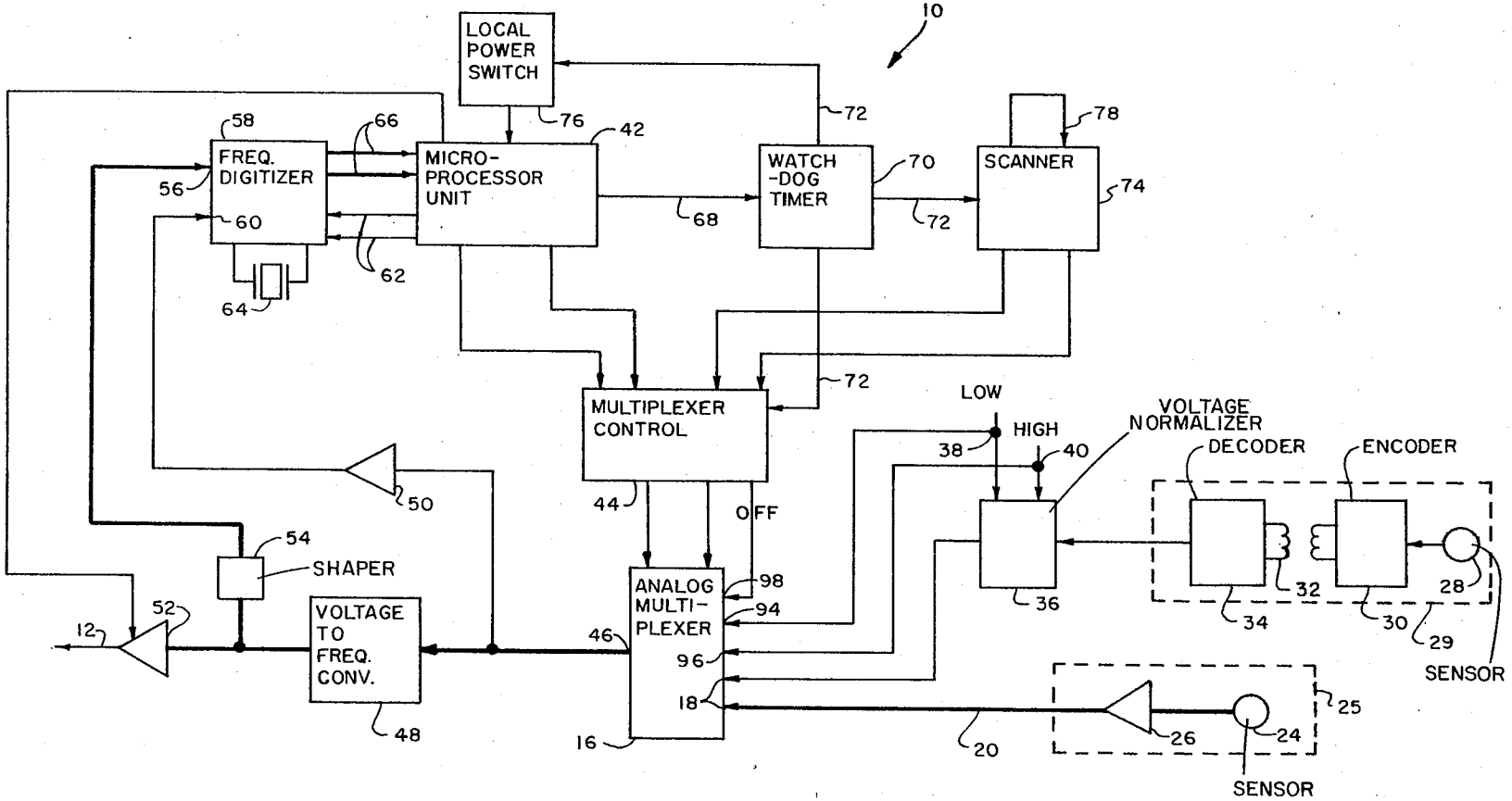
FIG. 2 is a single line block diagram showing the local portion of the system in one phase of a normal data acquisition mode.

FIG. 2, which shows local network 10 in the first phase of a normal data acquisition mode, uses (as do FIGS. 3 through 6) conventional single lines interconnecting the several elements to indicate the transmission of control signals over those lines and chickening of single lines to indicate transmission of data. In the mode shown, microprocessor stage 42 controls addressing of the input ports of multiplexer 16 via control 44. Control signals passing between microprocessor 42, multiplexer control 44 and multiplexer 16 sequentially address the input ports 18. Microprocessor unit 42 is shown in FIG. 2 addressing one of the several input ports 18 conveying low level data signals emanating from a locally deployed sensor 24. Simultaneously, microprocessor unit 42 controls frequency digitizer 58 to accept signals via input port 56. The low level analog signals connected by multiplexer 16 to output port 46 are changed by voltage-to-frequency converter 48 into variable frequency signals within the variable frequency high band. In the mode shown, data transmitter 52 is not enabled and therefore serves to isolate master data processing unit 14 from reception of variable frequency signals emanating from converter 48. The variable frequency signals within the high band are converted by the conjugate action of wave shaper 54 and frequency digitizer 48 into binary signals which are received, processed and temporarily stored by microprocessor stage 42.

Figure 3:
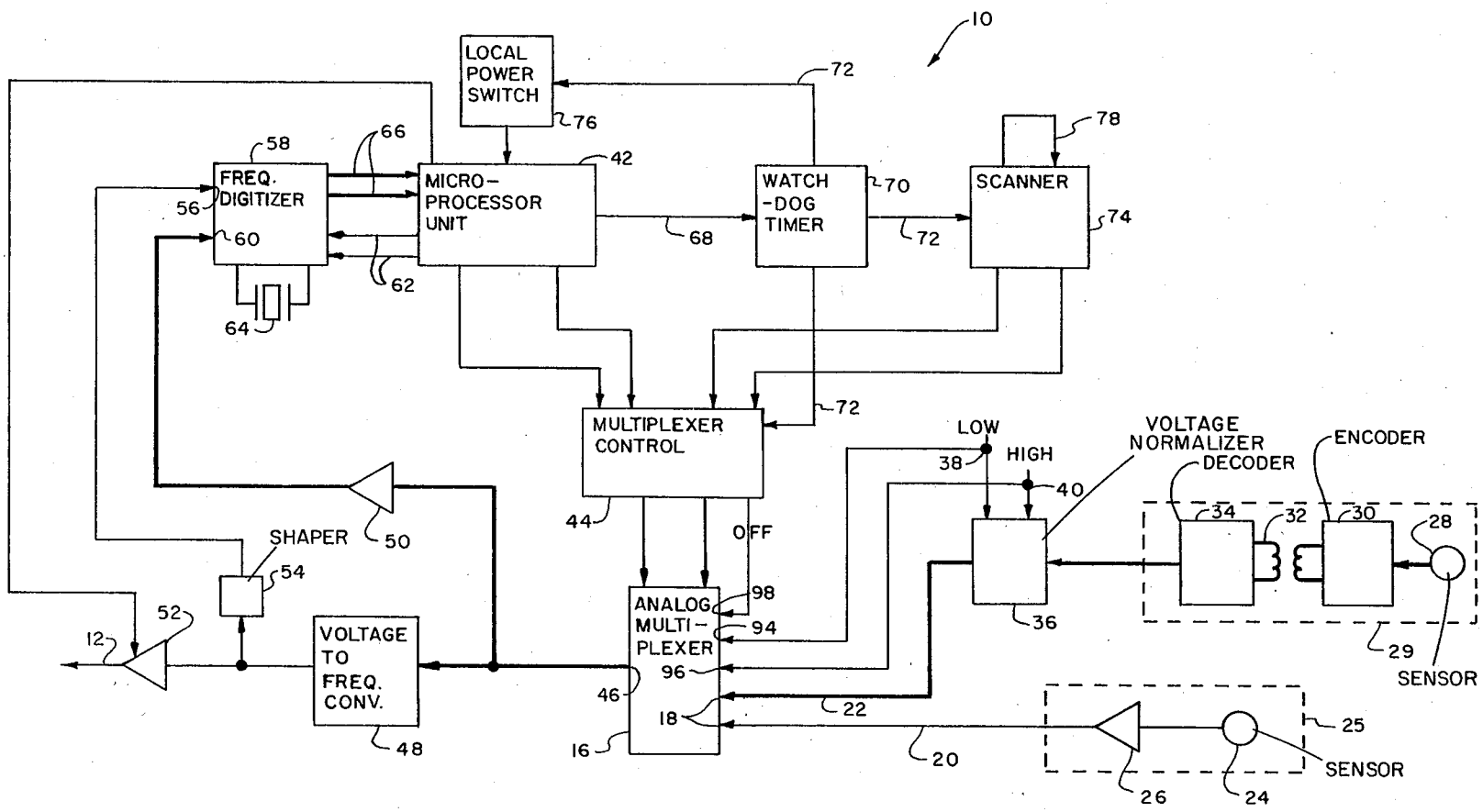
FIG. 3 is a single line block diagram of the local portion of the system in another phase of a normal data acquisition mode.

In the second phase of the normal data acquisition mode, shown in FIG. 3, microprocessor stage 42 simultaneously addresses those input ports 18 receiving frequency shift keyed data signals in the variable frequency low band via channels 22 and enables frequency digitizer 58 to receive signals via input port 60. As the variable frequency low band input channels 22 are sequentially addressed and connected to output port 46, comparator 50 normalizes the voltage amplitudes while frequency digitizer 58 converts the normalized signals into binary data which is then received, processed and temporarily stored in an internal memory of microprocessor stage 42. It may be noted that the high and low reference levels applied by normalizer 36 to the variable frequency low band signals differs from the input specification tolerances of frequency digitizer 58 and microprocessor unit 42, thereby necessitating the further normalization step with comparator 50. It is noted that in the modes shown in FIGS. 2 and 3, microprocessor stage 42 controls the input frequency counting interval utilized by frequency digitizer 58 for digitizing the data signals arriving via input ports 56, 60. This assures that the data signals supplied by frequency digitizer 58 have compatable ranges in the binary format when they are received by microprocessor stage 42.

Figure 4:
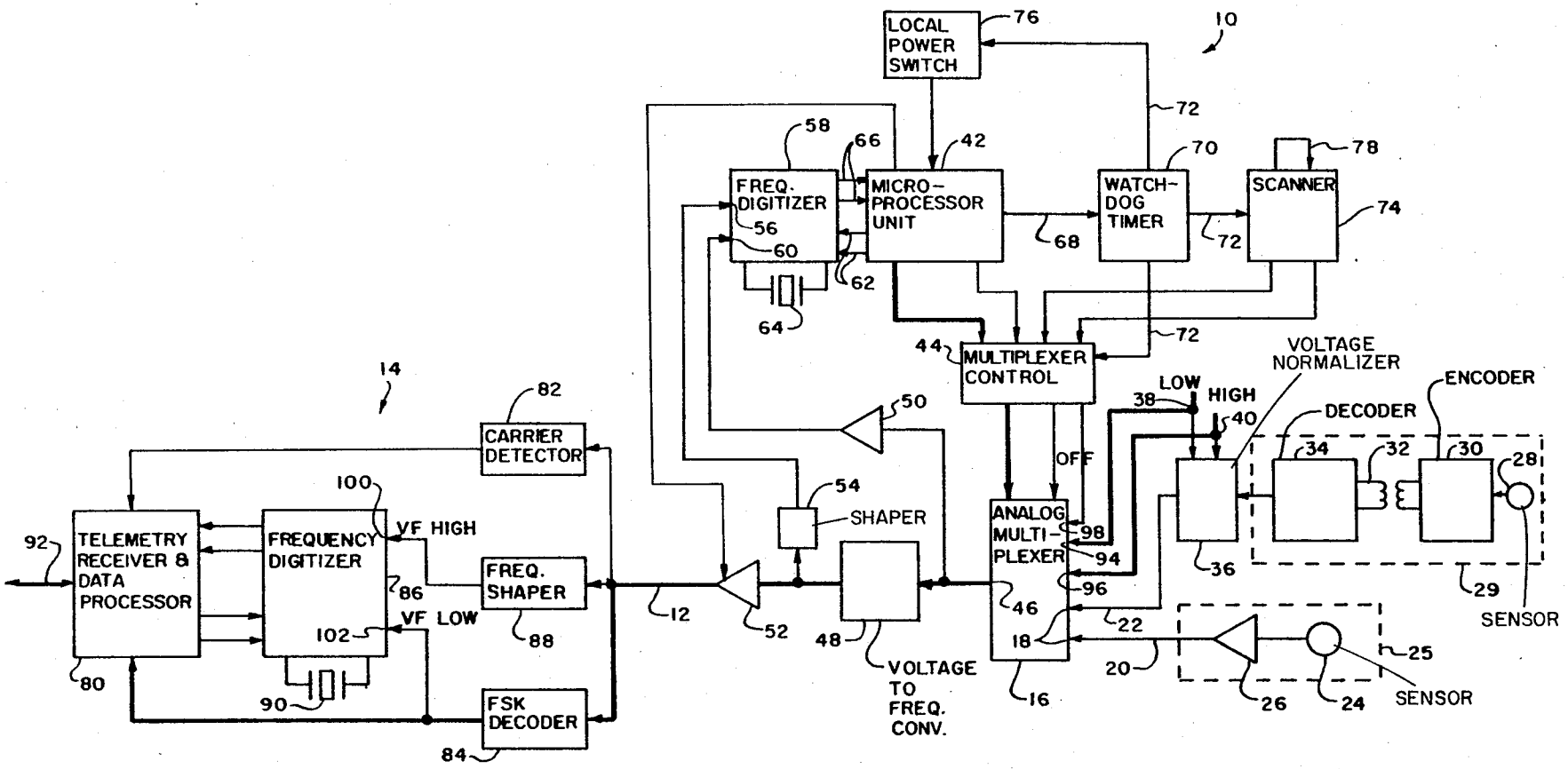
FIG. 4 is a single line block diagram of the system in a normal transmit mode.

In its normal data transmission mode, shown in FIG. 4, microprocessor stage 42 continually applies an address control signal via multiplexer control 44 to multiplexer 16. Simultaneously, microprocessor unit 42 applies the binary data signals via control 44 to multiplexer 16 which, in conjunction with the address control signal, allow the binary data signals to alternately address input ports 94, 96 coupled to the low 38 and high 40 reference potentials, respectively. This conjugate addressing of the input ports receiving the low and high reference potentials causes a binary data stream alternating between those potentials to be applied to converter 48, thereby producing a frequency shifted data signal within the variable frequency high band. While conjugately addressing multiplexer 16, microprocessor stage 42 controls local power switch 76 to continuously enable data transmitter 52, thereby causing the variable frequency high band encoded signals to be transmitted to master data processing unit 14.

Receiver and data processor 80 is programmed to receive incoming data signals via frequency shift decoder 84 during normal mode data transmission. Consequently, when carrier detector 82 senses the tone of the variable frequency high band signal, its application of a carrier detect signal to processor 80 alerts the processor to begin receiving and processing data received via decoder 84. In effect, decoder 84 converts the frequency shift keyed data signals within the variable frequency high band to binary data in a form acceptable to processor 80. Processor 80 is programmed to receive data signals via decoder 84 in the same sequence as those signals are transmitted by microprocessor stage 42. To enable processor 80 to distinguish between signals originating from different sensors, microprocessing stage 42 addresses the ZERO, or off, input port 98 of multiplexer 16 at the conclusion of transmission of each data signal, thereby disconnecting output port 46 from all of the input ports and interrupting the transmission of data and carrier signals to converter 48. Consequently, the output of converter 48 and transmission from transmitter 52 is temporarily blanked, thereby alerting processor 80 via carrier detector 82 to the completion of transmission of one data signal and the eminent transmission of the next signal within the transmission sequence. At the conclusion of the blanking interval, microprocessor stage 42 again begins addressing the low and high reference potentials applied to input ports 94, 96 with the conjugate action of its address control signal and the next binary data signal in the transmission sequence. Upon resumption of transmission, detector 82 again alerts processor 80 with a carrier detect signal, thereby causing processor 80 to resume reception of the binary data signal converted by decoder 84.

Operational failure of either microprocessor stage 42 or its control program will be detected by its periodic self-checking routine. Upon its conclusion, the self-checking routine emits a watchdog time pulse via lead 68, to timer 70. Detection of any failure within processor stage 42 prevents the self-checking routine from running to its conclusion. Consequently, the occurrence of a partial failure of either stage 42 or its control program will prevent the self-checking program from running to its conclusion and its generation of a watchdog time pulse. Timer 70 is cyclically reset by the watchdog time pulse; its absence will cause timer 70 to generate the mode shifting signal via leads 72 to deactivate microprocessor stage 42 by toggling switch 76 to remove the local power source from processor stage 42. Loss of power to microprocessor stage 42 removes its ability to inhibit the activation of data transmitter 52, which is therefore enabled for fallback mode operation. The mode shifting signal also causes control 44 to shift control of the multiplexer addressing function from microprocessor stage 42 to fallback mode scanner 74. When enabled by the mode shifting signal, scanner 74 addresses input ports 18 in fixed, predetermined sequence.

Figure 5:
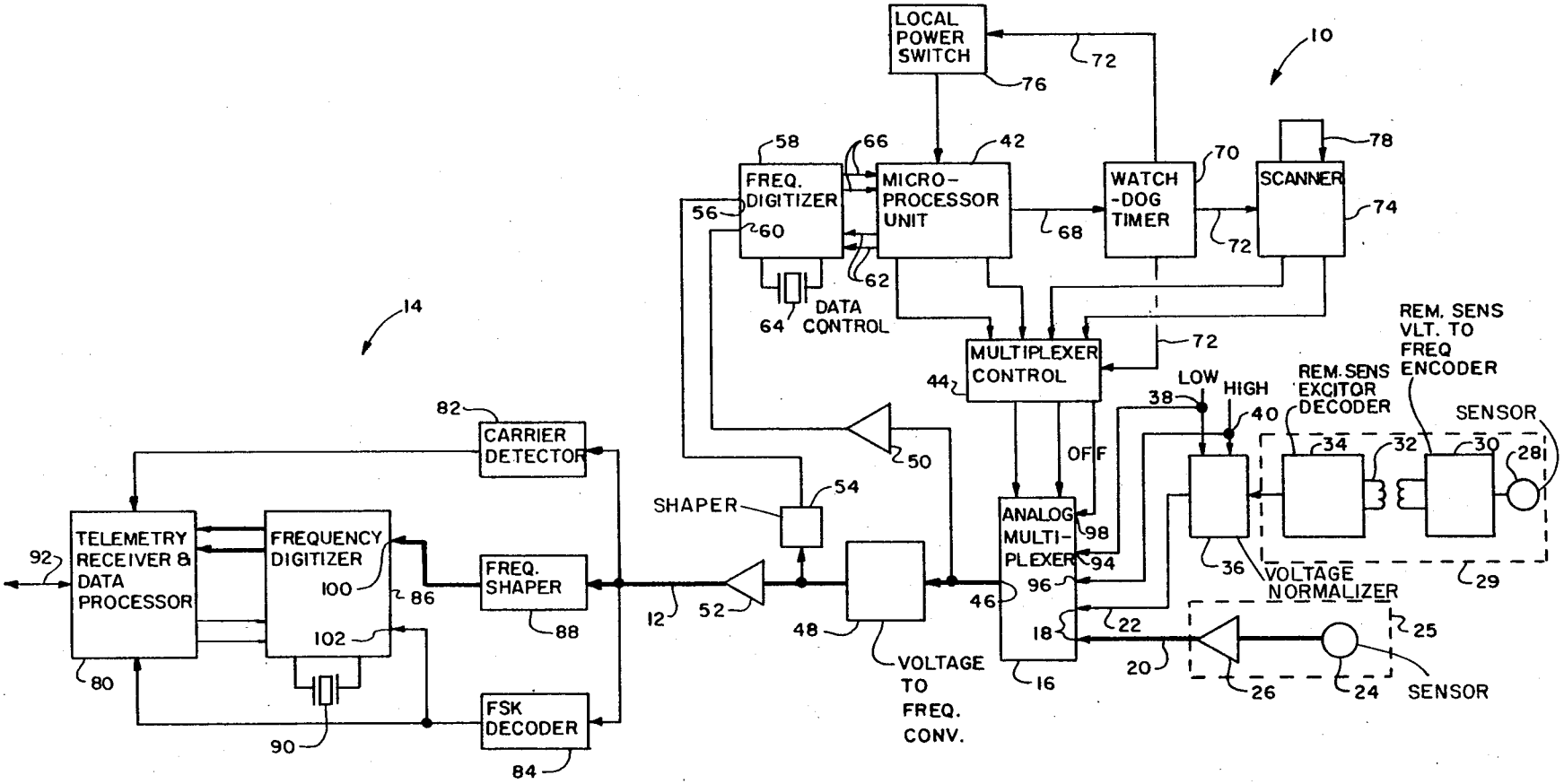
FIG. 5 is a single line block diagram of the system in one phase of a fallback mode.

As shown in FIG. 5, scanner 74 is addressing one of the input ports 18 receiving an analog signal emanating from a local sensor 24. This signal is coupled to output port 46 and changed to a variable frequency within the variable high frequency band by converter 48, amplified by transmitter 52 and sensed by carrier detector 82. Initially, telemetry receiver 80 attempts to receive these data signals via frequency shift decoder 84. The absence of frequency shift however causes the output from decoder 84 to remain in a single binary condition, an event which is subsequently detected by processor 80 during generation of the carrier detect signal. Ultimately, processor 80 reverts to a fallback reception mode patterned upon the same transmission sequence as that employed by scanner 74. In this mode, processor 80 controls frequency digitizer 86 to sequentially receive through its variable frequency high terminal 100, a preset number of incoming data signals via frequency shaper 88. In combination, frequency shaper 88 and digitizer 86 convert the variable frequency high band signals into binary data which is then applied directly to processor 80. Scanner 74 addresses ZERO input port 98 at the conclusion of acquisition and direct transmission of each data signal, thereby signalling processor 80 via detector 82 of the eminent transmission of the next data signal within the sequence.

Figure 6:
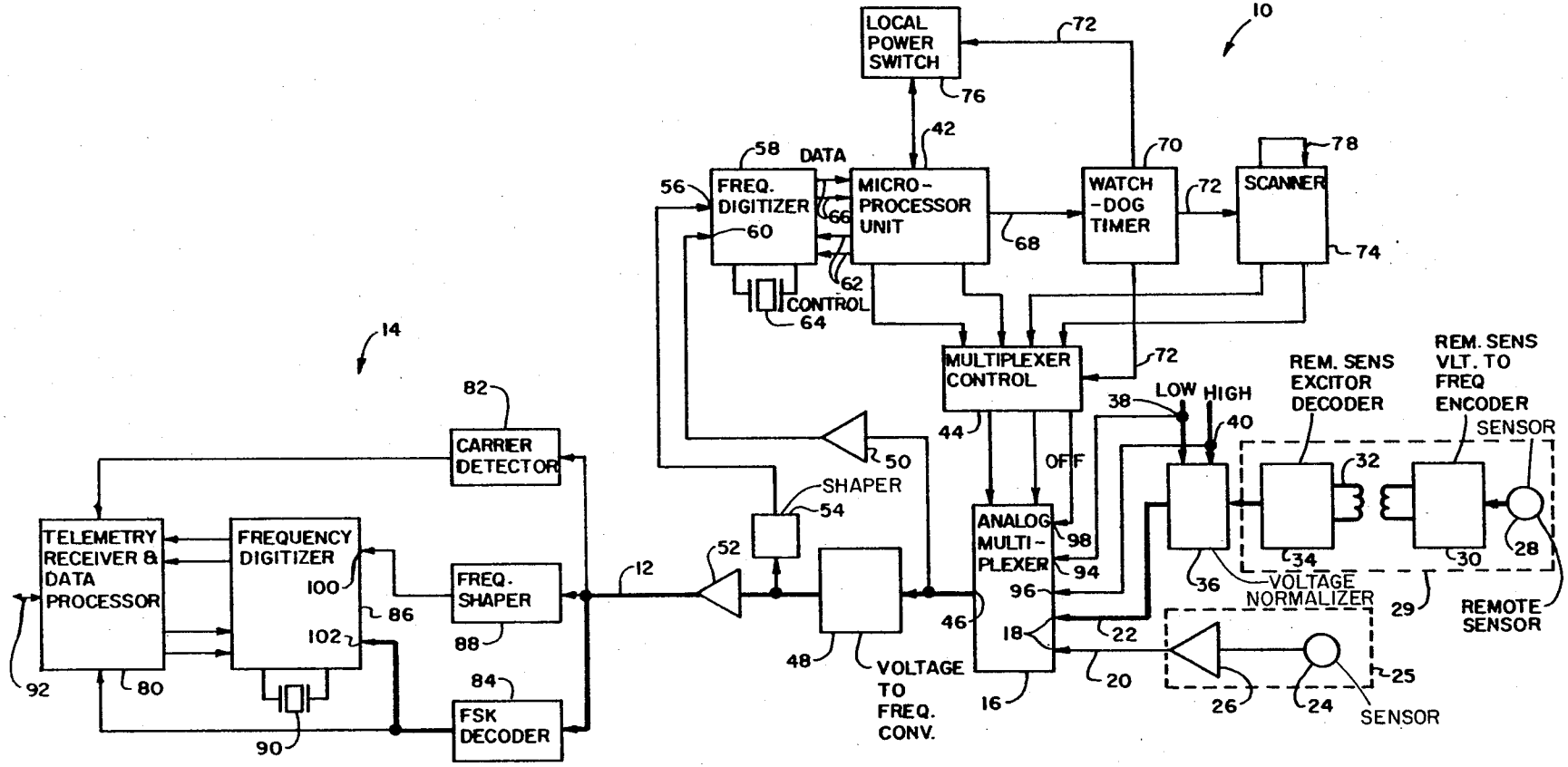
FIG. 6 is a single line block diagram of the system in another phase of a second fallback mode.

Refer now to FIG. 6. After detecting a preset number of blanking intervals during a sequence while in the fallback mode, processor 80 is alerted to the eminence of a shift in the format of data signals being acquired from the remote channels 22 and directly transmitted by local unit 10. Then, processor 80 enables frequency digitizer 86 to receive and convert incoming data signals via decoder 84 and variable frequency low input terminal 102. Simultaneously, scanner 74 continues through its data acquisition sequence by next addressing each input port 18 coupled to a normalized variable frequency low band signal. The scanner 74 also has the ability to lengthen the time during which each channel of the variable frequency low band signals is connected to the voltage to frequency converter 48. The normalization of these variable frequency low band signals by normalizer 36, in combination with the frequency conversion of those signals by converter 48 causes those signals to be amplified and transmitted by transmitter 52 as frequency shift keyed signals in the variable frequency high band. After decoding by shift key decoder 84 however, the resulting data signals must be converted at a different gating rate by digitizer 86 before application to processor 80. Consequently, the data signals are applied to digitizer 86 via input port 102 for binary conversion. After sequentially coupling all input ports 18 receiving both low level analog signals emanating from locally disposed sensors 24 and normalized variable frequency low band signals derived from remote sensors 28, scanner 74 precipitates a final blanking interval before re-initiating its preset scanning sequence. In this manner, network 10 assures continuous, uninterrupted data transmission from both the local and remote sensors even though the network has suffered a partial failure in its microprocessing stage. Data acquisition and transmission continues despite the differences between the signal formats produced by the local and remote sensor units.

It is apparent from the foregoing paragraphs that the invention disclosed provides a data acquisition system and method for accurate local acquisition, processing and transmission of data signals emanating from multiple variable frequency encoded data sources over a plurality of distinct and widely separated frequency bands. Moreover, reliable acquisition and transmission of data emanating from all of the data sources is accurately continued even after occurrence of failure of the microprocessor functions, through direct transmission of data signals in unprocessed form with direct variable frequency encoding of data signals acquired on higher frequency channels and frequency shift keying in the same variable frequency band of data signals acquired over low frequency channel.

I claimed:

1. A multiple-mode system for acquisition and processing of data over a plurality of channels from a plurality of sources comprising:

switching means having a plurality of addressable input ports and an output port, for connecting input signals occurring at selectively addressed ones of said input ports to said output port, a first plurality of said input ports being connectable to receive input signals exhibiting a first signal format and having a voltage amplitude indicative of acquired data, and a second plurality of said input ports being connectable to receive input signals exhibiting a second signal format within a first frequency band and having a frequency indicative of acquired data;

first converter means for changing said input signals exhibiting said first signal format from said output port into a first plurality of variable signals within a second frequency band when said output port is connected to said input ports, said variable signals exhibiting frequencies proportional to the voltage amplitudes of said input signals occurring at said input ports;

second converter means receptively coupled to said first converter means and said switching means for selectively changing said first plurality of variable signals within said second frequency band and said input signals exhibiting said second signal format within said first frequency band into digital signals;

first processing means connected between said second converter means and said switching means for sequentially addressing said input ports to selectively couple said input ports to said output port, for controlling operation of said second converter means, for storing and processing said digital signals, and for encoding said digital signals as a second plurality of variable signals within said second frequency band by alternately addressing selected ones of said input ports;

transmitter means periodically enabled by said first processing means and receptively coupled to said first plurality of variable signals from said first converter means for transmitting said second plurality of variable signals within said second frequency band while enabled;

detection means remotely located from and responsively coupled to said transmitter means for generating an indication signal in response to reception of a transmitted signal within said second frequency band;

decoding means remotely located from and operatively coupled to said transmitter means for providing digital data in response to reception of said second plurality of transmitted variable signals within said second frequency band; and second processing means remotely located from said first processing means and responsively coupled to said detection and decoding means for processing said digital data.

2. The data acquisition and processing system of claim 1, wherein:

said selectively addressed ones of said input ports include a first input port for receiving a low reference potential and a second input port for receiving a high reference potential; and said first processing means is coupled to apply said digital signals to said switching means while addressing alternate ones of said first input port and second input port in correspondence to the relative instantaeous amplitudes of said digital signals, whereby said first converter means provides said second plurality of variable signals modulated by said digital signals.

3. The data acquisition and receiving system of claim 1, further comprising:

sensing means for monitoring operation of said first processing means and for generating a mode-shifting signal to activate said transmitter means and deactivate said first processing means upon detection of a failure in said first processing means;

scanner means coupled to said sensing means, for sequentially addressing said input ports of said switching means in response to reception of said mode-shifting signal; and control means coupled to said sensing means interposed between said switching means, said first processing means and said scanner means for selectively permitting said first processing means to address said input ports of said switching means during the absence of said mode-shifting signal and for permitting said scanner means to sequentially address said input ports during generation of said mode-shifting signal.

4. The data acquisition and processing system of claim 3, further comprising:

third converter means operatively coupled between said transmitter means, decoding means and second processing means, and selectively enabled by said second processing means for changing said second plurality of transmitted variable signals within said second frequency band into digital data.

5. The data acquisition and processing system of claim 4, further comprising normalizing means connected to said second plurality of input ports and coupled to receive said low and high reference potentials, for restricting the amplitudes of said signals within said first frequency band to said reference levels.

6. The data acquisition and processing system of claim 5 wherein;

said second converter is responsive to the frequency of said first plurality of variable signals within said second frequency band and said input signals within said first frequency band; and said first processing means sequentially sets the number of cycles said second converter means responds to said input signals.

7. A multiple-mode system for acquisition of data over a plurality of channels from a plurality of sources, comprising:

switching means having a plurality of addressable input ports including a first input port for receiving a low reference potential, a second input port for receiving a high reference potential, and an output port, for connecting input signals occurring at selectively addressed ones of said input ports to said output port, a first plurality of said input ports being coupled to receive local signals having a voltage amplitude indicative of acquired data, and a second plurality of said input ports being coupled to receive input signals within a first frequency band and having a frequency indicative of acquired data;

first converter means for changing said local signals from said output port into a first plurality of variable signals within a second frequency band when said output port is connected to said input ports, said variable signals within said second frequency band exhibiting frequencies proportional to the voltage amplitude of said local signals occurring at said input ports;

second converter means receptively coupled to said first converter means and said switching means for selectively changing said first plurality of variable signals within said second frequency band and said input signals within said first frequency band into digital signals;

first processing means operatively connected between said second converter means and said switching means during a first mode, for performing an internal failure detection routine, for sequentially addressing said first and second plurality of input ports to selectively couple said input ports to said output port, for controlling conversion of said first plurality of variable signals within said second frequency band and said input signals within said first frequency band by said second converter means for storing and processing said digital signals, and for encoding said digital signals as variable signals within said second frequency band by addressing alternate ones of said first and second input ports in correspondence to the relative instantaeous amplitudes of said digital signals;

transmitter means periodically enabled by said first processing means during said first mode and coupled to said first plurality of variable signals from said first converter means for transmitting said variable signals within said second frequency band while enabled; and means for enabling said first processing means during said first mode and for enabling said transmitter means during a second mode;

means for monitoring said internal failure detection routine and for generating a mode-shifting signal initiating said second mode in response to detection of an internal failure by said detection routine; and addressing means enabled by said mode-shifting signal for sequentially addressing said input ports during said second mode to selectively couple said first and second plurality of input ports to said output port.

8. The data acquisition system of claim 7, further comprising a network normally located remotely from said transmitter means, including:

detection means responsively coupled to said transmitter means for generating an indication signal in response to receiption of a transmittal signal within said second frequency band generated by said transmitter means;

decoding means operatively coupled to said transmitter means for providing serial digital data in response to reception of said variable signals within said second frequency band; and second processing means responsively coupled to said detection and decoding means for processing said serial ditigal data.

9. The data acquisition system of claim 8, wherein said addressing means comprises:

scanner means enabling by said monitoring means during said second mode for sequentially addressing said input ports; and control means interposed between said switching means, said first processing means, and said scanner means, for permitting said first processing means to address said input ports of said switching means during said first mode and activated by said mode-shifting signal to shift addressing of said input ports to said scanner means during said second mode.

10. The data acquisition system of claim 9, wherein said network further comprises third converter means operatively coupled between said transmitter means, decoding means and second processing means, and selectively enabled by said second processing means for changing said variable signals within said second frequency band into digital data.

11. The data acquisition system of claim 10 wherein;

said second converter means is responsive to the frequency of said variable signals within said second frequency band and said input signals within said first frequency band; and said first processing means sequentially sets the number of cycles said second converter means responds to said input signals.

12. The data acquisition system of claim 11, wherein said switching means includes a third input port having no input signal, whereby said first processing means and said scanning means periodically address said third input port while sequentially addressing said first and second plurality of input ports.

13. A multiple-mode process for acquiring data over a plurality of channels from a plurality of sources, comprising:

connecting a first plurality of channels emitting input signals exhibiting a first signal format to a first plurality of input ports of a switchable device;

coupling a second plurality of channels emitting input signals within a first frequency band to a second plurality of input ports of said switchable device;

operating said switchable device to sequentially couple said first and second pluralities of input ports to an output port;

serially converting said signals exhibiting said first signal format at said output port into a first plurality of variable signals within a second frequency band, said first plurality of variable signals exhibiting frequencies proportional to the values of data represented by said input signals exhibiting said first signal format;

sequentially converting said first plurality of variable signals within said second frequency band and said input signals within said first frequency band into digital signals;

processing and storing said digital signals;

coupling a first and a second input port of said switchable means to receive a low and a high reference potential;

applying said digital signals to address and couple said first input port and said second input port to said output port in correspondence to the instantaneous value of said digital signals;

converting the analog values of said low and high reference potentials occurring at said output port into variable frequencies proportional to the instantaneous amplitudes of said analog values; and transmitting said first plurality of variable frequencies within said second frequency band to a distantly located receiver.

14. The process of claim 13, further comprised of:

periodically checking said processing step and providing an indication of the failure of said processing step;

monitoring said indication and generating a mode-shifting signal upon the occurrence of said indication;

shifting control of said switchable means to a preprogrammed sequence upon generation of said mode-shifting signal;

sequentially coupling said first plurality and second plurality of input ports to convert said input signals exhibiting said first signal format and said input signals within said first frequency band into variable signals within said second frequency band; and serially transmitting said variable signals within said second frequency band to said distantly located receiver.

15. The process of claim 14, further comprised of:

detecting a signal within said second frequency band at said distantly located receiver;

decoding said variable signals within said second frequency band at said distantly located receiver in response to detection of said signal within said second frequency band; and processing the decoded variable signals within said second frequency band in response to detection of said signal within said second frequency band.

* * * * *